US010861274B2

(12) United States Patent
Oh et al.

(10) Patent No.: US 10,861,274 B2
(45) Date of Patent: Dec. 8, 2020

(54) MULTI-DENOMINATION BANKNOTE CASSETTE INCLUDING VARIABLE STOPPER

(71) Applicant: HYOSUNG TNS INC., Seoul (KR)

(72) Inventors: Hye Bin Oh, Incheon (KR); Yun Seok Jeong, Suwon-si (KR)

(73) Assignee: HYOSUNG TNS INC., Seoul (KR)

( * ) Notice: Subject to any disclaimer, the term of this patent is extended or adjusted under 35 U.S.C. 154(b) by 248 days.

(21) Appl. No.: 16/089,319

(22) PCT Filed: Mar. 24, 2017

(86) PCT No.: PCT/KR2017/003175
§ 371 (c)(1),
(2) Date: Sep. 27, 2018

(87) PCT Pub. No.: WO2017/171312
PCT Pub. Date: Oct. 5, 2017

(65) Prior Publication Data

US 2020/0302725 A1 Sep. 24, 2020

(30) Foreign Application Priority Data

Mar. 31, 2016 (KR) ..... 10-2016-0039270

(51) Int. Cl.
*B65H 31/36* (2006.01)
*G07D 11/13* (2019.01)

(52) U.S. Cl.
CPC ..... *G07D 11/13* (2019.01); *B65H 31/36* (2013.01)

(58) Field of Classification Search
CPC .... B65H 31/20; B65H 31/36; B65H 2403/41; B65H 2405/1122; B65H 2405/324
See application file for complete search history.

(56) References Cited

U.S. PATENT DOCUMENTS 6,073,925 A * 6/2000 Sato ..... B65H 7/02 271/171
10,046,935 B2 * 8/2018 Kim ..... G07D 11/14
(Continued)

FOREIGN PATENT DOCUMENTS

JP H06-312872 A 11/1994
JP H07-220139 A 8/1995
(Continued)

OTHER PUBLICATIONS

PCT International Search Report and Written Opinion, PCT Application No. PCT/KR2017/003175, dated Jun. 30, 2017, 9 pages. [PCT Search Report in English].

*Primary Examiner* — Howard J Sanders
(74) *Attorney, Agent, or Firm* — Fenwick & West LLP

(57) ABSTRACT

The present invention relates to a multi-banknote cassette with a movable stopper, and more particularly, to a multi-banknote cassette with a movable stopper, which is capable of storing various kinds of banknotes at the same time. The multi-banknote cassette may include: a stopper driver which is formed at the top of a cassette body and has a pinion gear rotated by a driving motor; and a movable stopper which has a rack gear formed at one side surface thereof and engaged with the pinion gear and is lifted/lowered vertically through a stack guide to guide an introduced banknote in the cassette body, while the pinion gear of the stopper driver is rotated. Through such a structure, various kinds of banknotes can be easily handled in one banknote cassette.

7 Claims, 5 Drawing Sheets

(a)

(b)

(56) References Cited

U.S. PATENT DOCUMENTS

| | | | | |
|---|---|---|---|---|
| 2014/0035218 | A1* | 2/2014 | Koyama | B65H 33/08<br>271/3.14 |
| 2014/0312557 | A1* | 10/2014 | Ishikawa | B65H 1/14<br>271/18.1 |
| 2015/0368064 | A1* | 12/2015 | Nomura | B65H 31/26<br>271/3.15 |

FOREIGN PATENT DOCUMENTS

| | | | |
|---|---|---|---|
| JP | H08-198493 | A | 8/1996 |
| KR | 10-2009-0005965 | A | 1/2009 |
| KR | 10-2011-0031017 | A | 3/2011 |
| KR | 101250657 | B1 | 4/2013 |

* cited by examiner

PRIOR ART (a)

MULTI-DENOMINATION BANKNOTE CASSETTE INCLUDING VARIABLE STOPPER

TECHNICAL FIELD

The present disclosure relates to a multi-banknote cassette with a movable stopper, and more particularly, to a multi-banknote cassette with a movable stopper, which is capable of storing various kinds of banknotes at the same time. The multi-banknote cassette includes: a stopper driver which is formed at the top of a cassette body and has a pinion gear rotated by a driving motor; and a movable stopper which has a rack gear formed at one side surface thereof and engaged with the pinion gear and is lifted/lowered vertically through a stack guide to guide an introduced banknote in the cassette body, while the pinion gear of the stopper driver is rotated. When a banknote having a relatively small size among banknotes deposited into the banknote cassette is introduced into the banknote cassette, the movable stopper is lowered to protrude downward from the stack guide, and regulates the front end of the banknote. When a banknote having a relatively large size is introduced into the banknote cassette, the movable stopper is lifted to retreat upward from the stack guide, such that the front end of the introduced banknote is regulated through the banknote stopper installed at the rear of the stack guide. Through such a structure that aligns and stacks banknotes introduced into the banknote cassette in the storage space at a separator/stacker regardless of the kinds or sizes of the introduced banknotes, the multi-banknote cassette can raise the discharge efficiency of the banknotes through the separator/stacker, when the banknotes are discharged from the banknote cassette. Thus, various kinds of banknotes can be easily handled in one banknote cassette.

BACKGROUND ART

In general, an ATM (Automated Teller Machine) refers to an automated device which can provide a basic financial service such as deposit or withdrawal without a bank teller, regardless of time and place. Through an ATM, a customer can perform a transaction to withdraw or deposit a check and cash, using a medium such as a card or bankbook.

Such an ATM can be operated even after the business close time of a bank. Furthermore, ATMs can be installed in various places such as a department store, supermarket and convenience store, and operated in unattended mode. Thus, the number of installed ATMs tends to increase.

Recently, a circulation-type ATM has been widely spread, which circulates banknotes deposited through financial transactions of customers. The circulation-type ATM increases the operability to thereby improve the convenience of use for customers.

The circulation-type ATM includes a deposit/withdrawal part, a banknote detection part, a temporary storage part, a plurality of banknote cassettes, a reject box and a transfer path. The deposit/withdrawal part receives deposited banknotes or discharges banknotes to be withdrawn. The banknote detection part detects the kind of a banknote and determines whether the banknote is normal. The temporary storage part temporarily stores a deposited banknote until a transaction is established. The plurality of banknote cassettes store deposited banknotes for the respective kinds of the banknotes, and separate and discharge the stored banknotes when the banknotes are withdrawn. The reject box collects superimposed banknotes or damaged banknotes among the banknotes discharged from the plurality of banknote cassettes. The transfer path is used to transfer deposited or withdrawn banknotes.

Referring to FIG. 1 illustrating the structure of the conventional circulation-type banknote cassette included in the above-described ATM, the conventional circulation-type banknote cassette includes a cassette body 10, a support plate 20, a separator/stacker 30, a stack guide 40, and a banknote stopper 50. The cassette body 10 forms a storage space 11 for storing banknotes therein. The support plate 20 supports banknotes 1 stacked in the storage space 11 while lifted or lowered in the storage space 11. The separator/stacker 30 is installed at a banknote entrance/exit of the cassette body 10, and stacks banknotes carried into the cassette body 10 in the storage space 11 or separates banknotes 1 discharged from the cassette body 10 one by one. The stack guide 40 guides the banknotes 1 introduced into the storage space by the separator/stacker 30. The banknote stopper 50 is installed on the opposite wall surface of a wall surface where the separator/stacker 30 is installed in the cassette body 10, and regulates the front ends of the banknotes guided by the stack guide 40 such that the banknotes are aligned and stacked in the storage space 11 of the cassette body 10.

When a banknote is carried into the circulation-type banknote cassette having the above-described structure, the separator/stacker introduces the banknote into the storage space, and the banknote introduced into the storage space is guided through the stack guide, and falls into the storage space after the front end of the banknote collides with the banknote stopper installed on the wall surface of the cassette body. During this process, the banknote is stacked over the support plate of the storage space while being aligned with the banknotes stored in the storage space.

Therefore, when the banknotes are discharged from the banknote cassette, the aligned and stacked banknotes are separated one by one through the separator/stacker, and then transferred through the transfer path outside the banknote cassette.

The ATM may include a plurality of banknote cassettes installed for the respective kinds of the banknotes, or handle various kinds of banknotes through one banknote cassette in some cases. Recently, the use of a multi-banknote cassette capable of storing and handling various kinds of banknotes at the same time has increased in order to improve the convenience of use of the ATM while reducing the size of the ATM.

The sizes of banknotes used in Korea are similar to one another. Thus, the sizes of banknotes do not matter when one banknote cassette handles various kinds of banknotes. In other countries, however, various kinds of banknotes may have significantly different sizes from one another. In this case, when the conventional banknote cassette having the above-described structure is applied to handle various kinds of banknotes, serious problems may occur.

That is, since the conventional banknote cassette uses one fixed banknote stopper, the conventional banknote cassette has difficulties in aligning and storing various kinds of banknotes having different sizes. Therefore, when the banknote cassette handles various kinds of banknotes having different sizes, various troubles such as jam may occur while the banknotes are circulated.

For this reason, Korean Patent Registration No. 1,250,657 has disclosed a banknote cassette for various kinds of banknotes, which has two separate storage spaces in order to store two kinds of banknotes having different sizes in one cassette. In this case, however, the banknote cassette must have two storage spaces, two support plates and two separators/stackers. Therefore, the utilization efficiency of the space in the cassette is degraded while the manufacturing cost of the cassette is increased.

DISCLOSURE

Technical Problem

Various embodiments are directed to a multi-banknote cassette with a movable stopper, which is capable of storing various kinds of banknotes at the same time. The multi-banknote cassette includes: a stopper driver which is formed at the top of a cassette body and has a pinion gear rotated by a driving motor; and a movable stopper which has a rack gear formed at one side surface thereof and engaged with the pinion gear and is lifted/lowered vertically through a stack guide to guide an introduced banknote in the cassette body, while the pinion gear of the stopper driver is rotated. When a banknote having a relatively small size among banknotes deposited into the banknote cassette is introduced into the banknote cassette, the movable stopper is lowered to protrude downward from the stack guide, and regulates the front end of the banknote. When a banknote having a relatively large size is introduced into the banknote cassette, the movable stopper is lifted to retreat upward from the stack guide, such that the front end of the introduced banknote is regulated through the banknote stopper installed at the rear of the stack guide. Through such a structure that aligns and stacks banknotes introduced into the banknote cassette in the storage space at a separator/stacker regardless of the kinds or sizes of the introduced banknotes, the multi-banknote cassette can raise the discharge efficiency of the banknotes through the separator/stacker, when the banknotes are discharged from the banknote cassette. Thus, various kinds of banknotes can be easily handled through one banknote cassette.

Technical Solution

In an embodiment, there is provided a multi-banknote cassette with a movable stopper, which is installed in an automated teller machine (ATM) and stores different kinds of banknotes at the same time. The multi-banknote cassette may include: a cassette body having a banknote entrance/exit formed at one side thereof, and including an internal storage space for storing banknotes therein; a separator/stacker installed at the banknote entrance/exit of the cassette body, and configured to stack banknotes carried into the cassette body in the storage space or separate and transfer banknotes discharged from the cassette body one by one; a stack guide installed at the top of the storage space, and configured to guide a banknote introduced into the storage space by the separator/stacker; a movable stopper having a rack gear formed in a vertical direction at one side surface thereof, movably installed in the cassette body, and lifted to retreat upward from the stack guide or lowered to protrude downward from the stack guide through the stack guide; and a stopper driver installed at the top of the cassette body, having a pinion gear engaged with the rack gear of the movable stopper, and configured to lift/lower the movable stopper through an operation of rotating the pinion gear.

Advantageous Effects

According to the embodiment of the present invention, when a banknote having a relatively small size among banknotes deposited into the banknote cassette is introduced into the banknote cassette, the movable stopper is lowered to protrude downward from the stack guide, and regulates the front end of the banknote. When a banknote having a relatively large size is introduced into the banknote cassette, the movable stopper is lifted to retreat upward from the stack guide, such that the front end of the introduced banknote is regulated through the banknote stopper installed at the rear of the stack guide. Thus, since the banknotes introduced into the banknote cassette are aligned and stacked in the storage space at a separator/stacker regardless of the kinds or sizes of the introduced banknotes, the multi-banknote cassette can raise the discharge efficiency of the banknotes through the separator/stacker, when the banknotes are discharged from the banknote cassette. Thus, various kinds of banknotes can be easily handled through one banknote cassette.

Furthermore, the multi-banknote cassette with the movable stopper can align and stack banknotes in one storage space regardless of the kinds or sizes of the banknotes. Therefore, the space efficiency of the banknote cassette can be increased, which makes it possible to reduce the size of the ATM.

MODE FOR INVENTION

Hereafter, exemplary embodiments of the present invention will be described in detail. However, the present invention may be embodied in different forms and should not be constructed as limited to the embodiments set forth herein.

Figure 1:
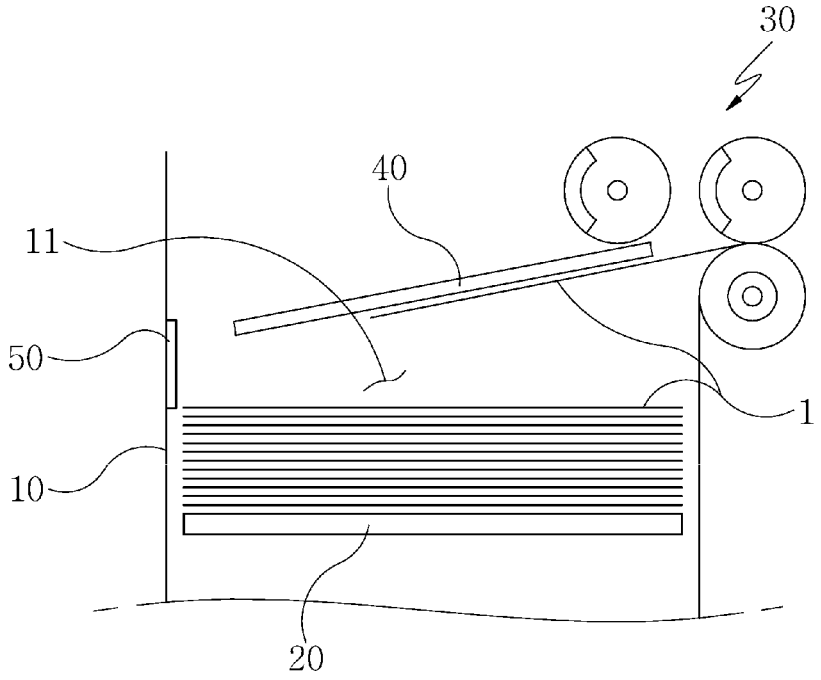
FIG. 1 illustrates the structure of a conventional banknote cassette.
Figure 2:
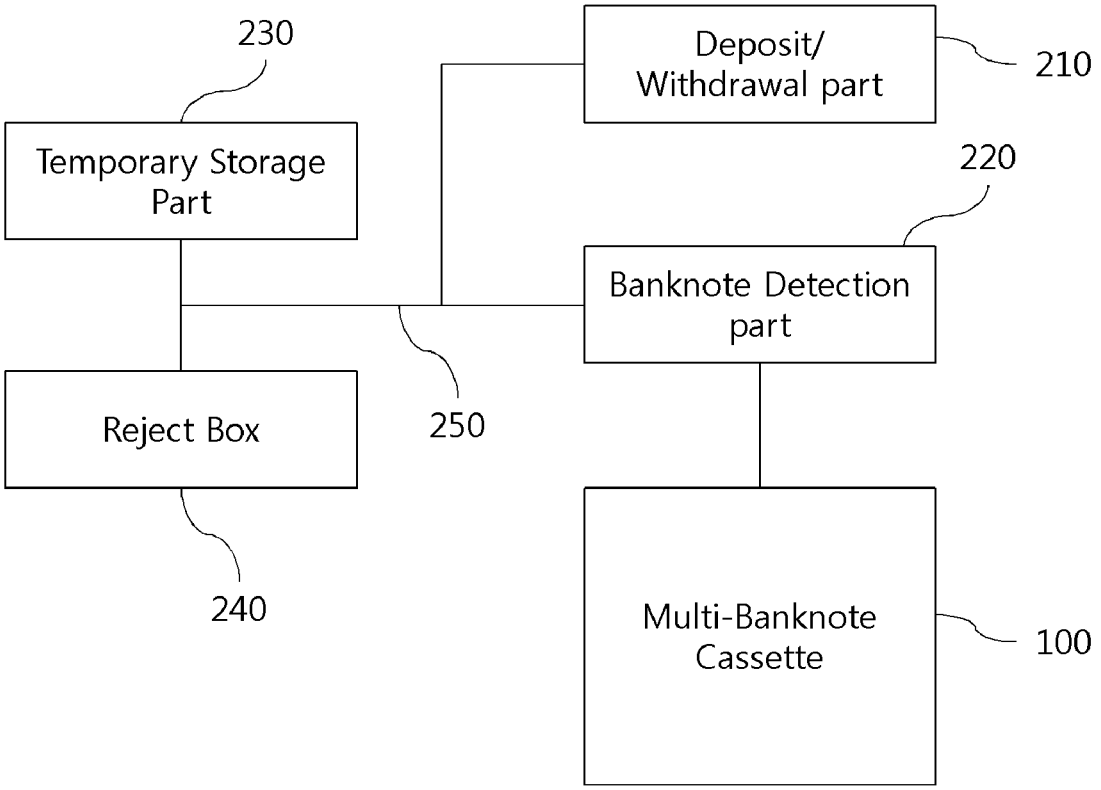
FIG. 2 schematically illustrates the structure of an ATM with a multi-banknote cassette according to an embodiment of the present invention.

FIG. 2 schematically illustrates the structure of an ATM with a multi-banknote cassette according to an embodiment of the present invention.

As illustrated in FIG. 2, the ATM with the multi-banknote cassette according to the embodiment of the present invention includes a deposit/withdrawal part 210, a banknote detection part 220, a temporary storage part 230, one or more multi-banknote cassettes, a reject box 240 and a transfer path 250. The deposit/withdrawal part 210 receives a deposited banknote or discharges a banknote to be withdrawn. The banknote detection part 220 detects the kind of a banknote, and determines whether the banknote is normal. The temporary storage part 230 temporarily stores a deposited banknote until a transaction is established. Each of the one or more multi-banknote cassettes is configured to align and store various kinds of banknotes having different sizes in one cassette at the same time. The reject box 240 collects superimposed banknotes or damaged banknotes among banknotes discharged from the multi-banknote cassette. The transfer path 250 is used to transfer a deposited or withdrawn banknote along a predetermined path.

The ATM having the above-described structure includes the multi-banknote cassette capable of storing various kinds of banknotes with different sizes at the same time. Thus, the ATM can receive and handle different kinds of banknotes through one banknote cassette without a plurality of banknote cassettes for storing the respective kinds of banknotes. Therefore, since the manufacturing cost and size of the ATM can be reduced, the ATM can be effectively installed in various places.

Even when the deposited and stored banknotes have different sizes, the multi-banknote cassette can effectively align and stack the banknotes having different sizes in the storage space at a separator/stacker. Therefore, when various kinds of banknotes having different sizes are withdrawn through the separator/stacker, the banknotes can be effectively discharged without a trouble such as jam.

Figure 3:
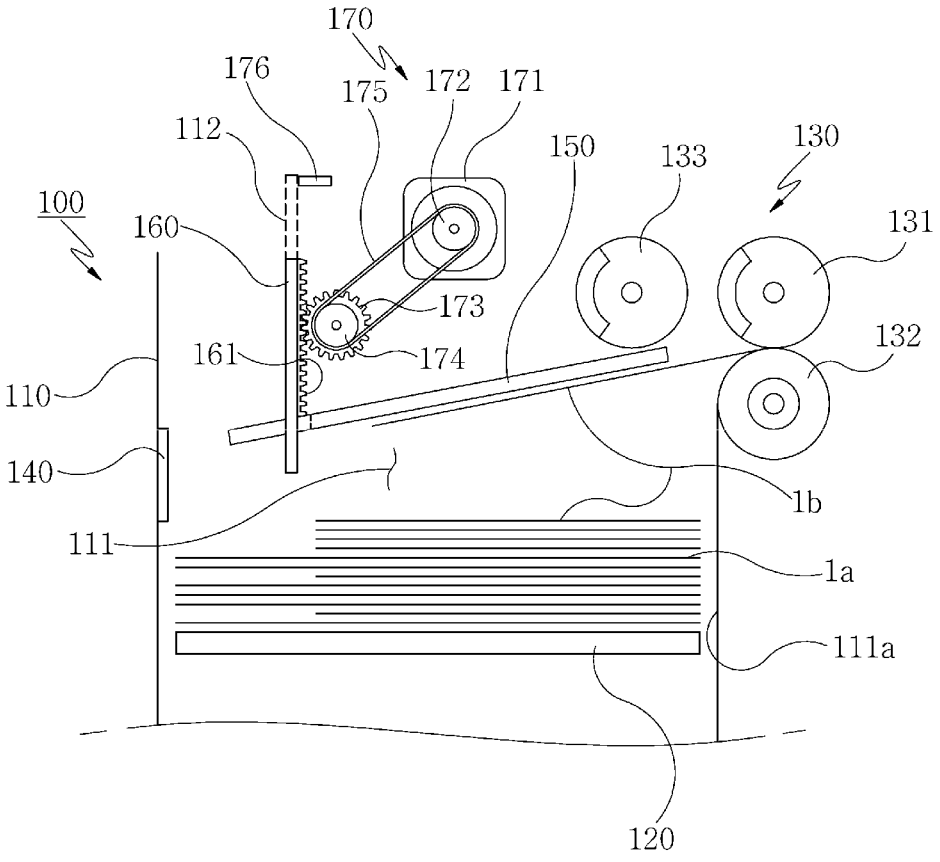
FIG. 3 illustrates the internal structure of the multi-banknote cassette with the movable stopper according to the embodiment of the present invention.

FIG. 3 illustrates the internal structure of a multi-banknote cassette with a movable stopper according to an embodiment of the present invention, and FIGS. 4A and 4B illustrate an operation process of the multi-banknote cassette with the movable stopper according to the embodiment of the present invention.

Figure 4:
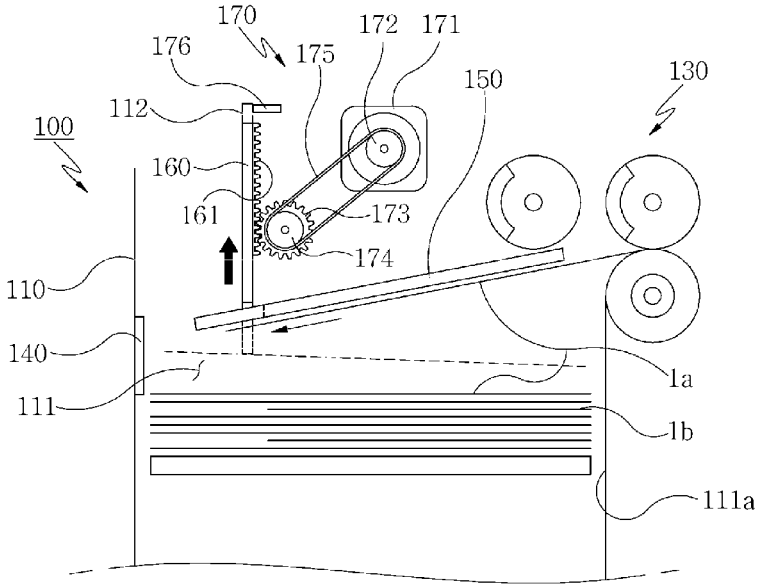
FIGS. 4A and 4B illustrate an operation process of the multi-banknote cassette with the movable stopper according to the embodiment of the present invention.
Figure 4:
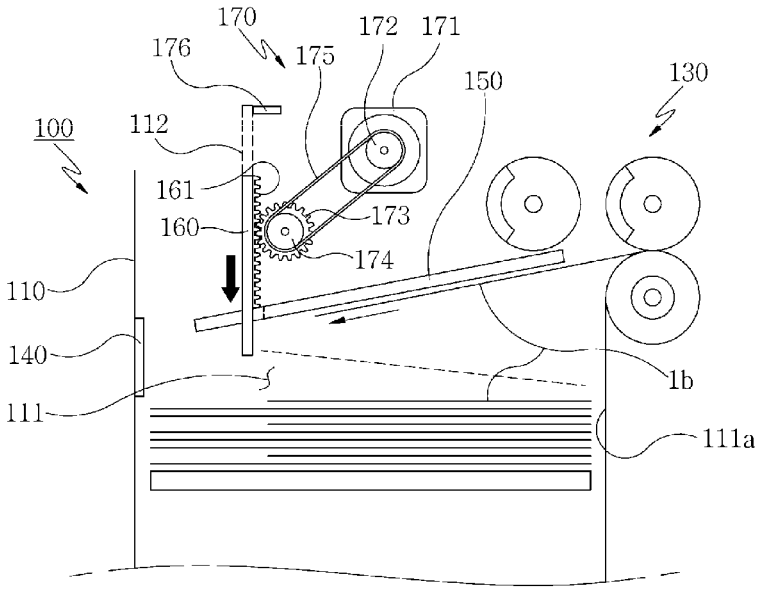

As illustrated in FIGS. 3 and 4, the multi-banknote cassette 100 with the movable stopper according to the embodiment of the present invention includes a cassette body 110, a support plate 120, a separator/stacker 130, a banknote stopper 140, a stack guide 150, a movable stopper 160 and a stopper driver 170. The cassette body 110 has a banknote entrance/exit formed at one side thereof, and includes an internal storage space 111 for storing banknotes. The support plate 120 supports banknotes stacked in the storage space 111 while lifted or lowered in the storage space 111. The separator/stacker 130 is installed at the banknote entrance/exit of the cassette body 10, and stacks banknotes carried into the cassette body 110 in the storage space 111 or separates and transfers banknotes discharged from the cassette body 110 one by one. The banknote stopper 140 is installed on the opposite wall surface of a wall surface where the separator/stacker 130 is installed in the cassette body 110. The stack guide 150 is installed at the top of the storage space 111, and guides banknotes introduced into the storage space 111 by the separator/stacker 130 toward the banknote stopper 140. The movable stopper 160 has a rack gear 161 formed in a vertical direction at one side surface thereof, is movably installed in the cassette body 110, and lifted to retreat upward from the stack guide 150 or lowered to protrude downward from the stack guide 150 through the stack guide 150. The stopper driver 170 is installed at the top of the cassette body 110, has a pinion gear 173 engaged with the rack gear 161 of the movable stopper 160, and lifts or lowers the movable stopper 160 through an operation of rotating the pinion gear 173.

That is, the multi-banknote cassette with the movable stopper according to the embodiment of the present invention includes: the stopper driver which is formed at the top of the cassette body and has the pinion gear rotated by the driving motor; and the movable stopper which has the rack gear formed at one side surface thereof and engaged with the pinion gear and is lifted/lowered vertically through the stack guide to guide an introduced banknote in the cassette body, while the pinion gear of the stopper driver is rotated. When a banknote having a relatively small size among banknotes deposited into the banknote cassette is introduced into the banknote cassette, the movable stopper is lowered to protrude downward from the stack guide, and regulates the front end of the banknote. When a banknote having a relatively large size is introduced into the banknote cassette, the movable stopper is lifted to retreat upward from the stack guide, such that the front end of the introduced banknote is regulated through the banknote stopper installed at the rear of the stack guide. Through the structure that aligns and stacks banknotes introduced into the banknote cassette in the storage space at the separator/stacker regardless of the kinds or sizes of the introduced banknotes, the multi-banknote cassette can raise the discharge efficiency of the banknotes through the separator/stacker, when the banknotes are discharged from the banknote cassette. Thus, various kinds of banknotes can be easily handled through one banknote cassette.

In the following embodiments, the structure of the multi-banknote cassette with the movable stopper, which can align and store various kinds of banknotes having different sizes at the same time, will be described in more detail with reference to the accompanying drawings.

In the following descriptions, among various kinds of banknotes which are stored in the multi-banknote cassette, a banknote having a relatively large size is defined as a first banknote 1*a*, and a banknote having a relatively small size is defined as a second banknote 1*b*.

The cassette body 110 is a box-shaped case for storing banknotes, and has a banknote entrance/exit formed at one side of the top thereof and a storage space 111 for storing banknotes therein.

At this time, the storage space 111 may be formed according to the size of the first banknote 1*a* having a larger size than the second banknote 1*b*, in order to store both of the first and second banknotes 1*a* and 1*b* having different sizes.

The support plate 120 is installed at the bottom of the storage space 111 in which banknotes are stored, and supports the banknotes stored in the storage space 111 while lifted/lowered in the storage space 111.

The cassette body 110 has vertical guide grooves 112 formed at both sidewalls thereof to guide the movable stopper 160 in the vertical direction.

The separator/stacker 130 is installed at the banknote entrance/exit of the cassette body 110, and stacks banknotes carried into the cassette body 110 in the storage space 111, or separates banknotes discharged from the cassette body 110 one by one and transfers the separated banknotes to the transfer path outside the banknote cassette 100.

As illustrated in FIG. 3, the separator/stacker 130 includes a feed roller 131, a separation roller 132 and a pickup roller 133. The feed roller 131 is installed at the banknote entrance/exit of the cassette body 110, and transfers a banknote carried into the storage space 111 or discharged from the storage space 111. The separation roller 132 is disposed at a position facing the feed roller 131, in order to transfer a banknote. When a banknote is discharged from the storage space 111, the separation roller 132 is pressed against the bottom surface of the banknote transferred through the feed roller 131, and separates another banknote which may be transferred at the same time. The pickup roller 133 is installed at the top of the storage space 111, and serves to pick up a banknote stored in the storage space 111 and transfer the banknote toward the feed roller 131, when the banknote is discharged from the storage space 111.

That is, when banknotes are carried into the storage space 111, the banknotes are transferred into the storage space 111 through the feed roller 131 and the separation roller 132, and stacked over the support plate 120. On the other hand, when banknotes stacked in the storage space 111 are discharged, the support plate 120 is lifted until the banknote stacked at the uppermost part of the support plate 120 is pressed against the pickup roller 133. Then, the stacked banknotes are sequentially picked up through the pickup roller 133 and discharged and transferred through the feed roller 131. Simultaneously, another banknote which is pressed against the bottom surface of the discharged and transferred banknote and transferred at the same time is separated through the separation roller 132 facing the feed roller 131. Therefore, the banknotes transferred through the feed roller 131 are discharged and transferred one by one.

The stack guide 150 is a guide plate installed at the top of the storage space 111, and serves to guide a banknote introduced into the storage space 111 by the separator/stacker 130 such that the banknote is easily stacked in the storage space 111.

As illustrated in FIG. 3, the stack guide 150 is installed at the top of the storage space 111 such that the end thereof is inclined downward, and guides a banknote toward the banknote stopper 140 installed on the wall surface of the cassette body 110, the banknote being introduced into the storage space 111 through the feed roller 131 and the separation roller 132 of the separator/stacker 130.

The stack guide 150 has a through-slit (not illustrated) formed in a plate body thereof such that the movable stopper 160 is passed through the through-slit while lifted/lowered.

The banknote stopper 140 is installed on the opposite wall surface of the wall surface where the separator/stacker 130 is installed in the cassette body 110. When banknotes are stacked, the banknote stopper 140 regulates the front ends of the banknotes which are introduced while guided by the stack guide 150. Therefore, the banknotes can be aligned and stored in the storage space 111.

That is, as illustrated in FIG. 4A, the front end of a banknote which is introduced into the storage space 111 while guided to the stack guide 150 through the separator/stacker 130, with the movable stopper 160 retreating upward, collides with the banknote stopper 140 installed on the wall surface of the cassette body 110. At this time, the banknote stopper 140 can correct the skew of the banknote while slowing down the introduction speed of the colliding banknote. Thus, the falling banknote can be stably aligned and stacked over the support plate 120 of the storage space 111.

At this time, the banknote stopper 140 is installed on the opposite wall surface of the wall surface where the separator/stacker 130 is installed in the cassette body 110, and regulates the front ends of the first banknotes 1*a* guided along the stack guide 150. Thus, the first banknotes 1*a* are stacked so that the rear ends thereof are aligned with the storage space wall surface 111*a* where the separator/stacker 130 is installed. The second banknotes 1*b* having a smaller size than the first banknotes 1*a* are stacked so as to be aligned with the storage space wall surface 111*a* by the movable stopper 160 to be described below.

The movable stopper 160 is guided by the vertical guide grooves 112 formed at the sidewalls of the cassette body 110, and lifted/lowered in the vertical direction in the cassette body 110. The rack gear 161 is formed in the vertical direction at one side surface of the movable stopper 160.

The movable stopper 160 is lifted or lowered by the stopper driver 170 so as to retreat upward from the stack guide 150 or protrude downward from the stack guide 150 through the through-slit (not illustrated) of the stack guide 150 in the cassette body 110.

That is, as illustrated in FIGS. 4A and 4B, the pinion gear 173 rotated by a driving motor 171 is installed at the top of the cassette body 110, and the rack gear 161 of the movable stopper 160 is engaged with the pinion gear 173. In such a structure, when the driving motor 171 rotates the pinion gear 173 in a forward or reverse direction, the movable stopper 160 is lifted to retreat upward from the stack guide 150 or lowered to protrude downward from the stack guide 150 through the through-slit (not illustrated) of the stack guide 150.

At this time, the movable stopper 160 is operated by the stopper driver 170, according to banknote information detected by a banknote detection part. When the first banknote 1*a* between the first and second banknotes 1*a* and 1*b* introduced into the cassette body 110 is carried into the cassette body 110, the movable stopper 160 is lifted to retreat upward from the stack guide 150, and passes the first banknote 1*a*. On the other hand, when the second banknote 1*b* having a smaller size than the first banknote 1*a* is carried into the banknote cassette 100, the movable stopper 160 is lowered to protrude downward from the stack guide 150, and regulates the front end of the second banknote 1*b* such that the rear end of the second banknote 1*b* is aligned with the storage space wall surface 111*a* at which the separator/stacker 130 is installed, due to its repulsive force.

Figure 5:
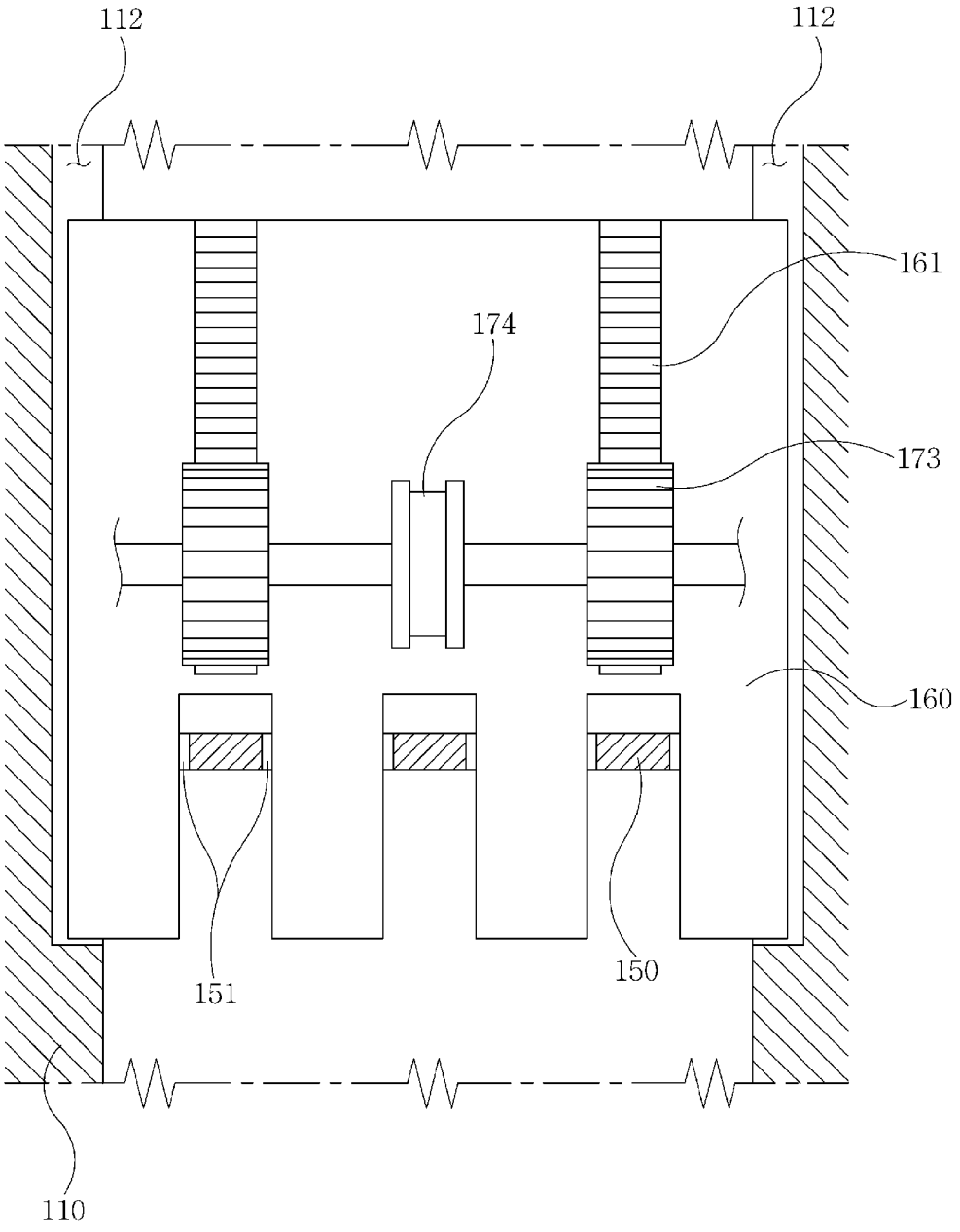
FIG. 5 illustrates a structure that guides a movable stopper to move upward and downward according to the embodiment of the present invention.

FIG. 5 illustrates a structure that guides the movable stopper to be lifted/lowered according to the embodiment of the present invention.

As illustrated in FIG. 5, the vertical guide grooves 112 to which both ends of the movable stopper 160 are inserted and coupled are formed at both sidewalls of the cassette body 110. Thus, the movable stopper 160 can be lifted/lowered along the vertical guide grooves 112 in the cassette body 110.

That is, the movable stopper 160 is lifted/lowered in the cassette body 110 along the vertical guide grooves 112 of the cassette body 110 by the stopper driver 170. During this process, the movable stopper 160 is moved upward from the stack guide 150 to retreat from the banknote introduction path or moved downward from the stack guide 150 to protrude into the banknote introduction path, through the through-slit 151 of the stack guide 150.

At this time, as illustrated in FIG. 5, the movable stopper 160 has a lower body portion corresponding to the through-slit 151 formed in the plate body of the stack guide 150. Thus, when the movable stopper 160 is lowered by the stopper driver 170, the lower body portion of the movable stopper 160 protrudes downward from the stack guide 150 through the through-slit 151 of the stack guide 150. When the movable stopper 160 is lifted by the stopper driver 170, the movable stopper 160 retreats upward from the stack guide 150 through the through-slit 151 of the stack guide 150.

The rack gear 161 engaged with the pinion gear 173 of the stopper driver 170 is formed at one side surface of the movable stopper 160. In the present embodiment as illustrated in FIG. 5, a pair of rack gears 161 may be formed at both sides of one side surface of the movable stopper 160, and a pair of pinion gears 173 may be axially fixed to the sidewalls of the cassette body 110 and engaged and rotated with the pair of rack gears 161, respectively. The rack/pinion structure lifts/lowers the movable stopper 160 along the vertical guide groove 112 in the cassette body 110.

The stopper driver 170 includes the pinion gears 173 installed at the top of the cassette body 110 and engaged with the rack gears 161 of the movable stopper 160, and serves to lift/lower the movable stopper 160 through an operation of rotating the pinion gears 173.

As illustrated in FIGS. 3 and 4, the stopper driver 170 includes a driving motor 171, a first pulley 172, the pinion gear 173, a second pulley 174 and a power transfer belt 175. The driving motor 171 is installed at the top of the cassette body 110 and has a driving shaft. The first pulley 172 is installed on the driving shaft of the driving motor 171. The pinion gear 173 is axially fixed to the sidewall of the cassette body 110 and engaged with the rack gear 161 of the movable stopper 160. The second pulley 174 is installed coaxially with the pinion gear 173 so as to be rotated in connection with the pinion gear 173. The power transfer belt 175 connects the first and second pulleys 172 and 174.

The stopper driver 170 lifts/lowers the movable stopper 160 to retreat upward from the stack guide 150 or protrude downward from the stack guide 150, according to banknote information detected by the banknote detection part installed in the ATM. When the first banknote 1*a* is introduced into the banknote cassette 100 as illustrated in FIG. 4A, the driving shaft of the driving motor 171 is rotated, the first pulley 172 coupled to the driving shaft rotates the second pulley 174 through the power transfer belt 175, and the pinion gear 173 interlocked with the second pulley 174 is engaged with the rack gear 161 of the movable stopper 160 and rotated to lift the movable stopper 160. Therefore, the movable stopper 160 is lifted toward the top of the stack guide 150 along the vertical guide grooves 112 so as to retreat from the stack guide 150. During this process, the first banknote 1*a* introduced into the banknote cassette 100 is guided along the stack guide 150, and stacked while aligned with the wall surface 111*a* at the separator/stacker 130 by the banknote stopper 140 installed on the inner wall of the cassette body 110.

On the movement path of the movable stopper 160 in the cassette body 110, a stopper sensor 176 may be installed to sense that the movable stopper 160 moves upward from a predetermined position.

That is, while the stopper driver 170 lifts the movable stopper 160 toward the top of the stack guide 150 through the pinion gear 173, the stopper sensor 176 senses whether the movable stopper 160 moves upward from the predetermined position, such that the movable stopper 160 does not collide with the uppermost wall surface of the cassette body 110. When a sensing signal is generated, the driving motor 171 is stopped to suspend the upward movement of the movable stopper 160.

When the second banknote 1*b* having a smaller size than the first banknote 1*a* is introduced into the banknote cassette 100 as illustrated in FIG. 4B, the driving shaft of the driving motor 171 is reversely rotated and the first pulley 172 coupled to the driving shaft reversely rotates the second pulley 174 through the power transfer belt 175, according to the opposite process of the process in FIG. 4A. Thus, the pinion gear 174 interlocked with the second pulley 174 is engaged with the rack gear 161 of the movable stopper 160 and rotated to lower the movable stopper 160, such that the movable stopper 160 is lowered through the through-slit 151 of the stack guide 150 along the vertical guide grooves 112 and protruded downward from the stack guide 150. During this process, the second banknote 1*b* introduced into the banknote cassette 100 is guided along the stack guide 150 while the front end of the banknote is regulated by the movable stopper 160, and stacked so as to be aligned with the storage space wall surface 111*a* at the separator/stacker 130.

That is, the front end of the second banknote 1*b* guided along the stack guide 150 collides with the movable stopper 160. At this time, the movable stopper 160 may correct the skew of the banknote while slowing down the speed of the banknote colliding with the movable stopper 160. Therefore, the falling second banknote 1*b* can be stably loaded on the support plate 120 of the storage space 111 while aligned with the storage space wall surface 111*a*.

The multi-banknote cassette with the movable stopper according to the present embodiment includes the banknote stopper and the movable stopper which are installed in the cassette body and correspond to the first and second banknotes having different sizes, such that the first and second banknotes can be aligned and stacked in one storage space at the same time. Therefore, when banknotes are discharged from the banknote cassette, the first and second banknotes having different sizes can be separated and discharged through the separator/stacker without a trouble. Thus, various kinds of banknotes having different sizes can be handled through one banknote cassette.

In the embodiment of the present invention, there has been described the multi-banknote cassette which includes the moveable stopper lifted/lowered through the rack/pinion structure interlocked with the driving motor in the cassette body, and can align and stack various kinds of banknotes having different sizes. However, the present invention is not limited thereto, but the above-described cassette structure may be applied to the deposit/withdrawal part 210 (refer to FIG. 2) which receives banknotes deposited by a customer or discharges banknotes to be withdrawn by a customer in the ATM.

As described above, when a banknote having a relatively small size among banknotes carried into the banknote cassette is introduced into the banknote cassette, the banknote cassette lowers the movable stopper to protrude downward from the stack guide, thereby regulating the front end of the introduced banknote. On the other hand, when a banknote having a relatively large size is introduced into the banknote cassette, the banknote cassette lifts the movable stopper to retreat upward from the stack guide, thereby regulating the front end of the introduced banknote through the banknote stopper installed at the rear of the stack guide. Through such a structure that aligns and stacks banknotes introduced into the banknote cassette regardless of the kinds or sizes of the banknotes, the banknote cassette can raise the discharge efficiency of the banknotes through the separator/stacker when the banknotes are discharged. Therefore, different kinds of banknotes can be easily handled through one banknote cassette.

Furthermore, the banknote cassette with the movable stopper according to the embodiment of the present invention is configured to align and stack banknotes in one storage space at the separator/stacker regardless of the kinds or sizes of the banknotes. Therefore, the space efficiency of the banknote cassette can be increased, which makes it possible to reduce the size of the ATM.

While various embodiments have been described above, it will be understood to those skilled in the art that the embodiments described are by way of example only. Accordingly, the disclosure described herein should not be limited based on the described embodiments.

INDUSTRIAL APPLICABILITY

The banknote cassette with the movable stopper according to the embodiment of the present invention can easily align and stack various kinds of banknotes in one storage space through the movable stopper installed therein. Therefore, the space efficiency of the banknote cassette can be increased, which makes it possible to reduce the size of the ATM.

The invention claimed is:

1. A multi-banknote cassette with a movable stopper, which is installed in an automated teller machine (ATM) and stores different kinds of banknotes at the same time, comprising:

a cassette body having a banknote entrance/exit formed at one side thereof, and including an internal storage space for storing banknotes therein;

a separator/stacker installed at the banknote entrance/exit of the cassette body, and configured to stack banknotes carried into the cassette body in the storage space or separate and transfer banknotes discharged from the cassette body one by one;

a stack guide installed at the top of the storage space, and configured to guide a banknote introduced into the storage space by the separator/stacker;

a movable stopper having a rack gear formed in a vertical direction at one side surface thereof, movably installed in the cassette body, and lifted to retreat upward from the stack guide or lowered to protrude downward from the stack guide through the stack guide; and a stopper driver installed at the top of the cassette body, having a pinion gear engaged with the rack gear of the movable stopper, and configured to lift/lower the movable stopper through an operation of rotating the pinion gear, wherein the cassette body has vertical guide grooves formed at inner walls of both sides thereof to guide the movable stopper in the vertical direction, and both sides of the movable stopper are inserted into the vertical guide grooves such that the movable stopper is lifted/lowered.

2. The multi-banknote cassette of claim 1, wherein the cassette body has a banknote stopper disposed on the opposite wall surface of a wall surface where the separator/stacker is installed in the cassette body, and configured to regulate the front end of the banknote guided through the stack guide.

3. The multi-banknote cassette of claim 2, wherein when the banknote introduced into the storage space has a relatively small size, the stopper driver lowers the movable stopper to protrude downward from the stack guide, and the movable stopper regulates the front end of the introduced banknote, and when the banknote introduced into the storage space has a relatively large size, the stopper driver lifts the movable stopper to retreat upward from the stack guide, and the banknote stopper regulates the front end of the introduced banknote, such that various kinds of banknotes having different sizes are aligned and stacked in the storage space.

4. The multi-banknote cassette of claim 1, wherein the stopper driver comprises:

a driving motor installed at the top of the cassette body and having a driving shaft;

a first pulley installed on the driving shaft of the driving motor;

a second pulley installed coaxially with the pinion gear so as to rotate in connection with the pinion gear; and a power transfer belt connecting the first and second pulleys, and wherein the pinion gear is axially fixed to sidewalls of the cassette body.

5. The multi-banknote cassette of claim 1, wherein the rack gear comprises a pair of rack gears formed at both sides of one surface of the movable stopper, and the pinion gear comprises a pair of pinion gears engaged with the pair of rack gears, respectively.

6. The multi-banknote cassette of claim 1, wherein the stack guide has a through-slit corresponding to the movable stopper such that the movable stopper is retreated upward from the stack guide or protruded downward from the stack guide through the stack guide.

7. The multi-banknote cassette of claim 1, wherein the cassette body has a stopper sensor installed on a movable stopper movement path at the top of the stack guide and configured to sense whether the movable stopper is retreated upward from a predetermined position.

* * * * *